US005309715A

United States Patent [19]

Kinnersly

[11] Patent Number: 5,309,715

[45] Date of Patent: May 10, 1994

[54] STIRLING ENGINES

[75] Inventor: Richard F. Kinnersly, Romsey, United Kingdom

[73] Assignee: ESD Engines Limited, United Kingdom

[21] Appl. No.: 949,482

[22] PCT Filed: Apr. 17, 1991

[86] PCT No.: PCT/GB91/00600

§ 371 Date: Oct. 16, 1992

§ 102(e) Date: Oct. 16, 1992

[87] PCT Pub. No.: WO91/16534

PCT Pub. Date: Oct. 31, 1991

[30] Foreign Application Priority Data

Apr. 17, 1990 [GB] United Kingdom ..... 9008523

[51] Int. Cl.[5] ..... F01B 29/10; F02G 1/04

[52] U.S. Cl. ..... 60/517; 277/96.1; 277/100

[58] Field of Search ..... 60/517, 525; 277/96.1, 277/100

[56] References Cited

U.S. PATENT DOCUMENTS

| | | | |
|---|---|---|---|
| 2,616,247 | 11/1952 | Liebe | 60/517 |
| 3,185,489 | 5/1965 | Lohr | 277/100 |
| 4,392,350 | 7/1983 | Marks | 60/525 X |
| 4,553,392 | 11/1985 | Chagnot et al. | 60/517 |
| 4,645,212 | 2/1987 | Lundholm . | |
| 5,085,054 | 2/1992 | Katsuda et al. | 60/517 |

FOREIGN PATENT DOCUMENTS

| | | | |
|---|---|---|---|
| 804979 | 5/1951 | Fed. Rep. of Germany . | |
| 1084605 | 1/1955 | France . | |
| 2528109 | 12/1983 | France . | |
| 55-37540 | 3/1980 | Japan . | |
| 58850 | 2/1947 | Netherlands | 60/517 |
| 179872 | 5/1922 | United Kingdom . | |
| 348895 | 5/1931 | United Kingdom . | |
| 379169 | 8/1932 | United Kingdom . | |
| 477609 | 1/1938 | United Kingdom . | |
| 555426 | 8/1943 | United Kingdom . | |
| 229430 | 2/1965 | United Kingdom . | |
| 1000622 | 8/1965 | United Kingdom . | |
| 1182876 | 3/1970 | United Kingdom . | |
| 1510465 | 5/1978 | United Kingdom . | |
| 1584287 | 2/1981 | United Kingdom . | |
| 2167124 | 5/1986 | United Kingdom . | |

*Primary Examiner*—Edward K. Look
*Assistant Examiner*—Hoang Nguyen
*Attorney, Agent, or Firm*—Davis, Bujold & Streck

[57] ABSTRACT

A Stirling engine with mechanical output through a crankshaft (57) has piston(s) (42) reciprocable in cylinder bore(s) (41). The piston to crankshaft connection includes a lever arm (74) on pivot pin (77) and a connecting rod (75). The lever arm passes through opening (76) which is sealed from the engine crankcase by an annular seal member (94) engaged against part spherical seat (91) on the lever arm by gas pressure and by a spring washer (65).

10 Claims, 3 Drawing Sheets

STIRLING ENGINES

The invention relates to Stirling engines. In referring to a Stirling engine we include those engines which operate on a cycle resembling the Stirling cycle but with some overlap and merging of the individual phases of the classical Stirling cycle.

The invention is applicable particularly but not exclusively to Stirling engines of the multi-cylinder double-acting type. Typical engines of this type have a hot working chamber at one end, normally the upper end and a cold working chamber at the other end of each cylinder separated by the piston, each of these hot and cold working chambers being connected respectively to a cold or hot working chamber of another cylinder. In this way, four closed working volumes are established in each of which the required working fluid is permanently entrapped. Conventional lubricants can not normally be used within the working volume because the lubricant carbonises and carbonised deposits interfere with heat transfer capability.

This kind of design often incorporates an axial piston rod extending through a sliding seal in the cylinder, running in a cross head bearing and then connected to a shaft, typically through a normal crank drive. Sliding seals of this nature tend to suffer from high friction and wear problems and wear compensation is difficult to achieve with such a seal. The reduced effective piston area caused by the piston rod can also be a disadvantage.

Alternatives to sliding seals such as rolling diaphragm seals or use of pressurised crankcases with simple crank mechanisms introduce other problems such as unreliability for the sliding seal and excess weight in reducing crankcase volume.

In our co-pending PCT patent application filed simultaneously herewith and claiming priority from our UK application 9008522.6 we describe a reciprocatory Stirling engine in which a connection between the piston and a main shaft comprises a lever arm pivotable intermediate its ends and extending through the cylinder wall, connected at one end thereof to the piston and at the other end thereof to the main shaft.

An object of the present invention is to provide an effective seal arrangement for such a lever arm.

According to the present invention there is provided a Stirling engine comprising a drive member, a cylinder, a piston reciprocable in the cylinder, a connection between the piston and the drive member comprising a lever arm pivotable about a pivot bearing intermediate its ends and extending through the cylinder wall and a gas seal arranged to prevent escape of pressure from the cylinder in the region of the lever arm, the seal comprising a part spherical seat on the lever arm with its centre coincident with the pivot axis, an annular seal member with a part spherical sealing surface in sealing contact with the part spherical seat and means for urging the seal member into sealing engagement with the seat.

Preferably the pivot bearing comprises a pivot pin passing through the lever arm and mounted at both ends in a pivot housing.

Preferably the connection between the piston and the drive member defines a limit of pivotal movement for the lever arm and the width of the sealing surface is greater than the movement of a corresponding part of the part spherical seat when the lever arm moves between its limits of pivotal movement such that there is a specific annular area on the surface of the seat which is and always remains in engagement with the sealing surface.

Preferably the seal member is carried in a movable seal holder which is supported in a fixed carrier and is urged by gas pressure in the engine, which may be supplemented by a spring, into engagement with the seal seat The annular seal member may be arranged to rotate about its own axis to distribute wear evenly around the sealing surface. This rotation may be derived from movement of the lever arm through a pawl which engages a ratchet wheel which in turn drives the seal member through a reduction gear.

Embodiments of the invention will now be described by way of example only with reference to the accompanying drawings in which.

Figure 1:
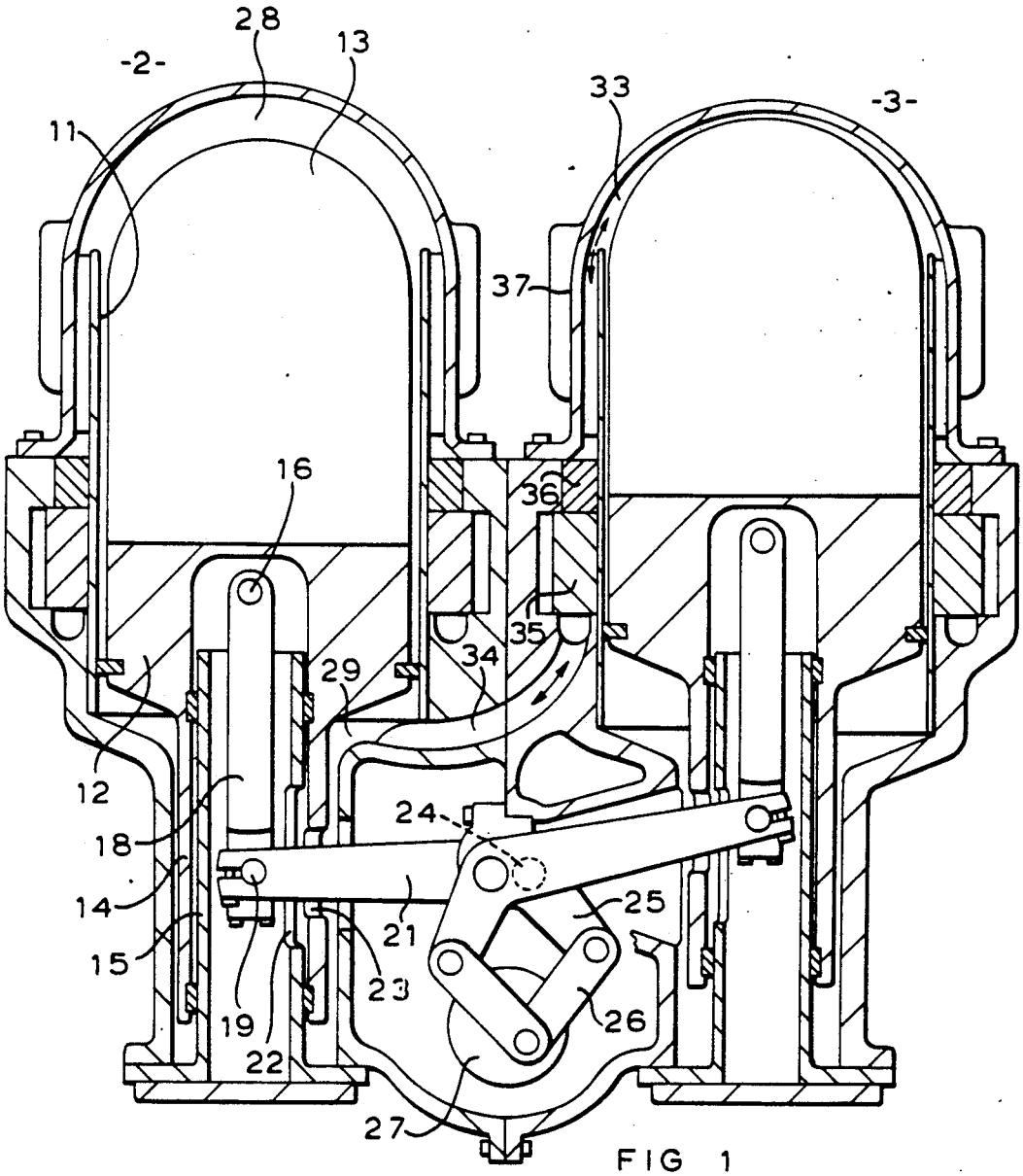
FIG. 1 is a diagrammatic cross-section through a four cylinder engine in accordance with the invention.

FIG. 1 is a diagrammatic cross section through a four cylinder Stirling engine showing two of its cylinders. The engine layout incorporates two banks of two cylinders and one cylinder from each bank is shown. These are referenced cylinders 2 and 3. The other cylinder in the same bank as cylinder 2 is referred to as cylinder 1 and the other cylinder, in the same bank as cylinder 3 is referred to as cylinder 4. Cylinder 2 is typical. It has a main bore 11 in which a piston 12 with integral displacer 13 reciprocates. The piston incorporates a downwardly extending piston body tube 14 which surrounds a fixed tubular piston guide 15 so that the piston 12 is guided on guide 15 rather than by the internal surface of cylinder 11. The cylinder has a major upper diameter corresponding to the full diameter of the piston and a minor lower diameter slightly greater than the diameter of the piston body tube. A generally vertical link 18 connects the piston to a lever arm 21 through pivot pins 16 and 19. The lever arm passes through slots 22 and 23 in the piston guide 15 and piston body tube 14 respectively.

The lever arm has a fixed pivot 24 and a cranked extension 25. A connecting rod 26 interconnects the cranked extension 25 with a crankshaft 27. In this way, reciprocation of piston 12 is connected to rotation of the crankshaft 27.

An upper or hot working chamber 28 is provided within the cylinder above the displacer 13. The space below the piston 12 is closed off and forms a lower or cold working chamber 29. Each cold working chamber is sealed with respect to the crankcase 30 so that the crankcase is unpressurised and parts within it can be lubricated conventionally. The sealing arrangement for arm 21 will be described with reference to FIG. 2.

The mechanical arrangement of a piston 32 for cylinder 3 reciprocable in a cylinder bore 31 is a mirror image of the arrangement for cylinder 2. Piston 32 is connected to crankshaft 27 by a crank pin arranged to provide a 90° phase difference between the reciprocation of pistons 12 and 32.

As illustrated, the cold chamber 29 of cylinder 2 is connected by a gas passage 34 to the hot chamber 33 of cylinder 3. This connection is made via a cooler 35 a regenerator 36 and a heater 37 adjacent the hot chamber 33. In practice the heating is provided by combustion gases ducted over the upper part of the cylinder and the cooler uses water as a coolant. Arrows indicate the flow of working fluid between the hot and cold chambers By means of gas passage 34, cold chamber 29 and hot chamber 33 are united into a single closed working volume within which working gas operates broadly in accordance with the Stirling engine cycle.

Cylinder 2 is offset axially of the crankshaft 27 to a sufficient extent to allow clearance between adjacent lever arms, connecting rods and crankshaft connections. The other two cylinders 1 and 4 are arranged respectively behind cylinders 2 and 3 and are not shown. They are similarly offset slightly from each other and are connected to the crankshaft via crank pins set at suitable angles to give 90° phase angles between cylinders 1 and 2, 2 and 3, 3 and 4 and thus also 4 and 1. Cylinder 2 is shown at mid-stroke while cylinder 3 is at TDC. There are a total of 4 gas passages corresponding generally to gas passage 34, each connecting the cold chamber of one cylinder with the hot chamber of an adjacent cylinder. In each case there is a corresponding 90° phase angle between each pair of interconnected chambers.

Figure 2:
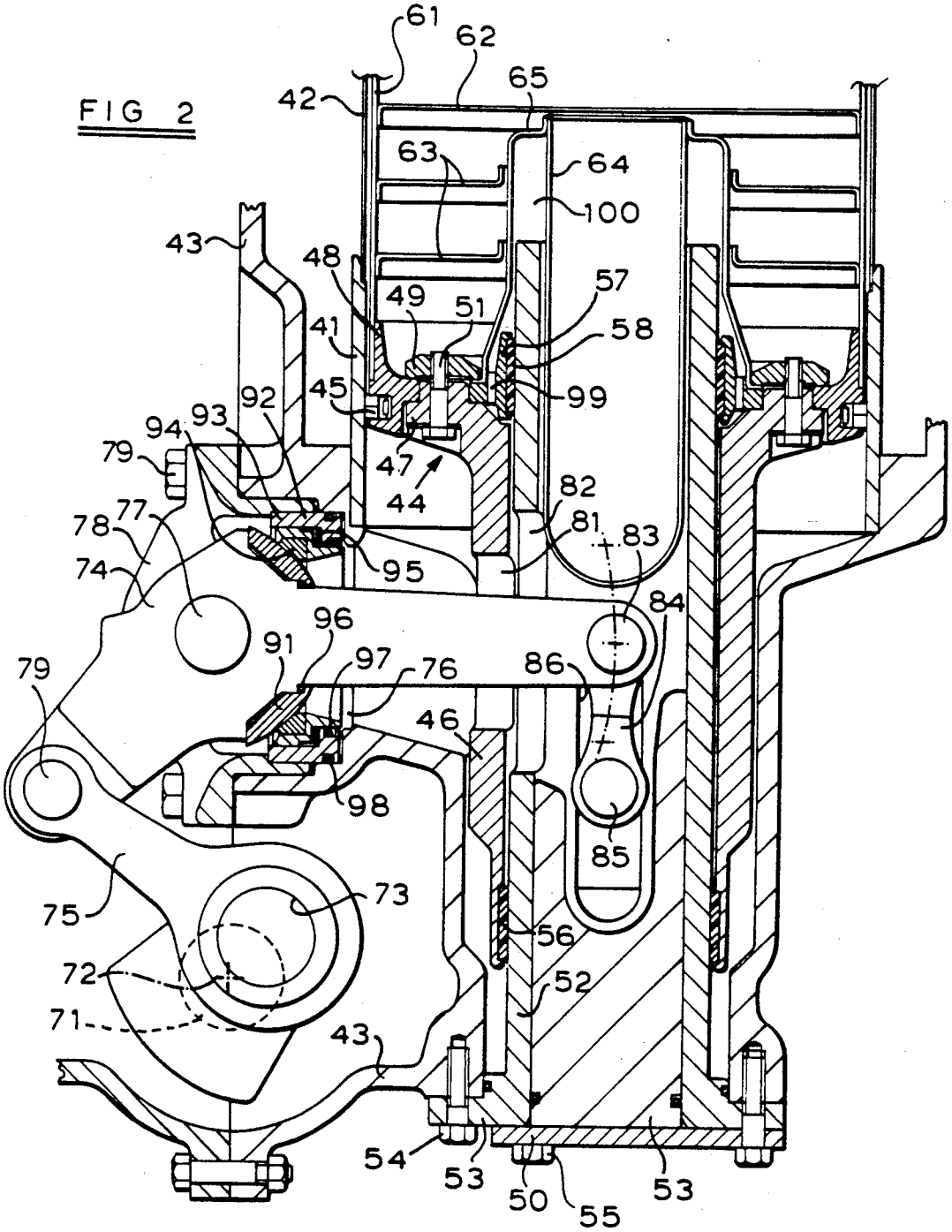
FIG. 2 shows part of such an engine in greater detail.

This general arrangement of four cylinders, 90° phase angles and interconnection of hot and cold working chambers is a well known form of Stirling engine layout, known as the Rinia layout so further details of its operation and will not be described here. FIG. 2 shows details of one cylinder of an engine similar to that of FIG. 1 but with some detail differences in layout.

The cylinder for the engine is constituted primarily by a stainless steel cylinder liner 41 the internal face of which provides a surface against which a piston seal 45 slides. The cylinder extends upward into a heater head by means of a closed cylindrical stainless steel spinning which forms a heater head liner. In use heat is applied continuously to the heater head so that working fluid is heated and the space above the piston becomes a hot working chamber Similarly the region below the piston is cooled continuously, for example by a water cooler surrounding the liner 41 to provide a cold working chamber below the piston. Further details of the heating and cooling arrangements may be as in FIG. 1. The interior surface of the liner 42 makes no contact with the piston or a displacer carried on the piston. The liner 41 itself is carried in a main casting 43 which forms an outer cylinder and also forms part of the crankcase of the engine.

A piston 44 is arranged to reciprocate in the cylinder but makes no direct contact with the cylinder for guidance. A sliding seal between the piston and cylinder is constituted by a piston ring assembly 45.

The primary structural element of the piston is a cast aluminium alloy piston body tube 46 of substantially greater length than a conventional piston. The piston body tube 46 incorporates an upper external flange 47 on which is mounted an outer piston body 48 of stainless steel carrying the piston ring 45 in an external annular groove. The outer piston body 48 is secured to flange 47 by interlocking spigots between these components, a retaining ring 49 and bolts 51 passing through flange 47 and retaining ring 49. The retaining ring 49 holds other components in position and these will be described subsequently.

A fixed cylindrical tubular piston guide 52 extends up into the cylinder in an axial direction. It is secured at its lower end to the crankcase formed by casting 43 as will now be explained. The piston guide 52 incorporates a lower external flange 53 which forms a spigotted connection to the crankcase and is secured to the crankcase by a ring of studs 54. The lower end of the piston guide 52 is closed by an externally flanged closure member 50 which is secured to the crankcase by bolts 55, these bolts passing through flange 53 and thus providing further fixing for the piston guide 52. Separate sets of bolts 54 and 55 are provided so that the piston guide 52 can be installed before the closure member 50 as an aid to assembly of other parts of the engine.

The piston is guided for sliding movement on the piston guide 52 which extends up into the piston body tube 46.

The interior of the piston tube body forms a recess which is closed at its upper end as will be described subsequently. The interior surface of the piston body tube 46 carries a lower annular bearing pad 56 and also supports a bearing pad carrier 57 which carries an upper bearing pad 58. These bearing pads are typically of bronze impregnated PTFE. The piston guide 52 is typically formed of electroless nickel/PTFE plated mild steel to provide a bearing surface for the pads 56 and 58 which will operate satisfactorily in an oil free environment.

The upper bearing pad carrier 57 is secured in a spigot at the upper end of the piston body tube by the retaining ring 49.

The piston 44 also incorporates a displacer crown assembly made up from stainless steel sheet pressings and spinnings. This is conventional Stirling engine technology so only part of the displacer crown assembly is shown. The drawing shows part of a dome-topped cylindrical displacer crown 61. A series of full flanged bulkheads 62 and open-centre flanged bulkheads 63 serve to restrict heat transfer from above the displacer crown into the body of the piston and also to stiffen the displacer crown. Blocks of lightweight thermal insulation material may be arranged between and supported by adjacent bulkheads. The displacer crown 61 itself is mounted on the outer piston body 48 and is secured by spot welding.

The upper part of the displacer crown assembly closes the recess in the piston across the piston diameter above the upper end of the piston body tube 46 so that the interior of this tube becomes a recess open at its lower end and closed at its upper end.

For the functioning of the Stirling engine, it is desirable that the free volume below the piston including the volume within the recess referred to above should be kept to a reasonable minimum For this purpose, a domed cylindrical internal filler member 64 is mounted on the piston to form part thereof and extends down inside the piston body tube 46. Filler member 64 is a stainless steel spinning and it is mounted in position by a further spun member 65 which in turn is secured to the piston body tube 46 by retaining ring 49. Members 64 and 65 also help to restrict heat transfer down through the piston.

As thus far described, piston 44 is freely slidable in an axial direction in cylinder 41 and is guided to slide on the axially extending piston guide 52 by lower and upper bearing pads 56 and 58. This guide mechanism holds the outer surface of the piston clear of the cylinder 41.

Piston ring 45 serves only as a sliding seal and not as a guide for the piston. Because of the laterally unsupported displacer crown well above the upper pad 58, a near-constant sliding fit between this pad and the piston guide is particularly important to piston location.

A crankshaft 71 is mounted in the crankcase formed in main casting 43 to rotate about an axis 72 in bearings which are not shown. The crankshaft has a conventional offset crank pin 73. The main components interconnecting the piston and crankshaft are a lever arm 74 and a connecting rod 75.

Lever arm 74 extends through an opening 76 which is effectively within the wall of the cylinder. It is pivotally mounted about a pivot bearing comprising a pivot pin 77 which is fixed at both ends in a pivot housing 78 secured by bolts 79 to the main casing 43. The outer end of lever arm 74 is connected by pin 79 to the connecting rod 75 and in this way, crankshaft rotation is coupled to reciprocatory pivotal movement of the lever arm 74.

The inner end of the lever arm 74 extends into the cylinder 41 and lies substantially on the axis of the cylinder. To provide clearance for insertion and reciprocation, the piston body tube 46 incorporates a slot 81 and the piston guide 52 incorporates a slot 82. Lever arm 74 terminates in an upper piston pivot pin 83 which connects the lever arm to a piston link 84 which is forked to provide pivot pin anchorages to both sides of the lever arm 74. A lower piston pivot pin 85 passes through the lower end of the piston link and through slots 86 in the piston guide 52 to terminate in bores (not shown) in the piston body tube 46. In this way, the piston 44 is connected for reciprocal movement with the lever arm 74, the link 84 catering for the radial component of movement of the lever arm 74 with respect to the cylinder.

Conventional lubrication can be employed for the crankshaft and connecting rod bearings and for the pivotal movement of the lever arm 74 about pivot pin 77. Lubrication passages can also be provided in the lever arm 74 and link 84 to provide lubrication for pivot pins 83 and 85. Alternatively the pivot pins 83 and 85 may employ dry lubrication techniques.

Figure 3:
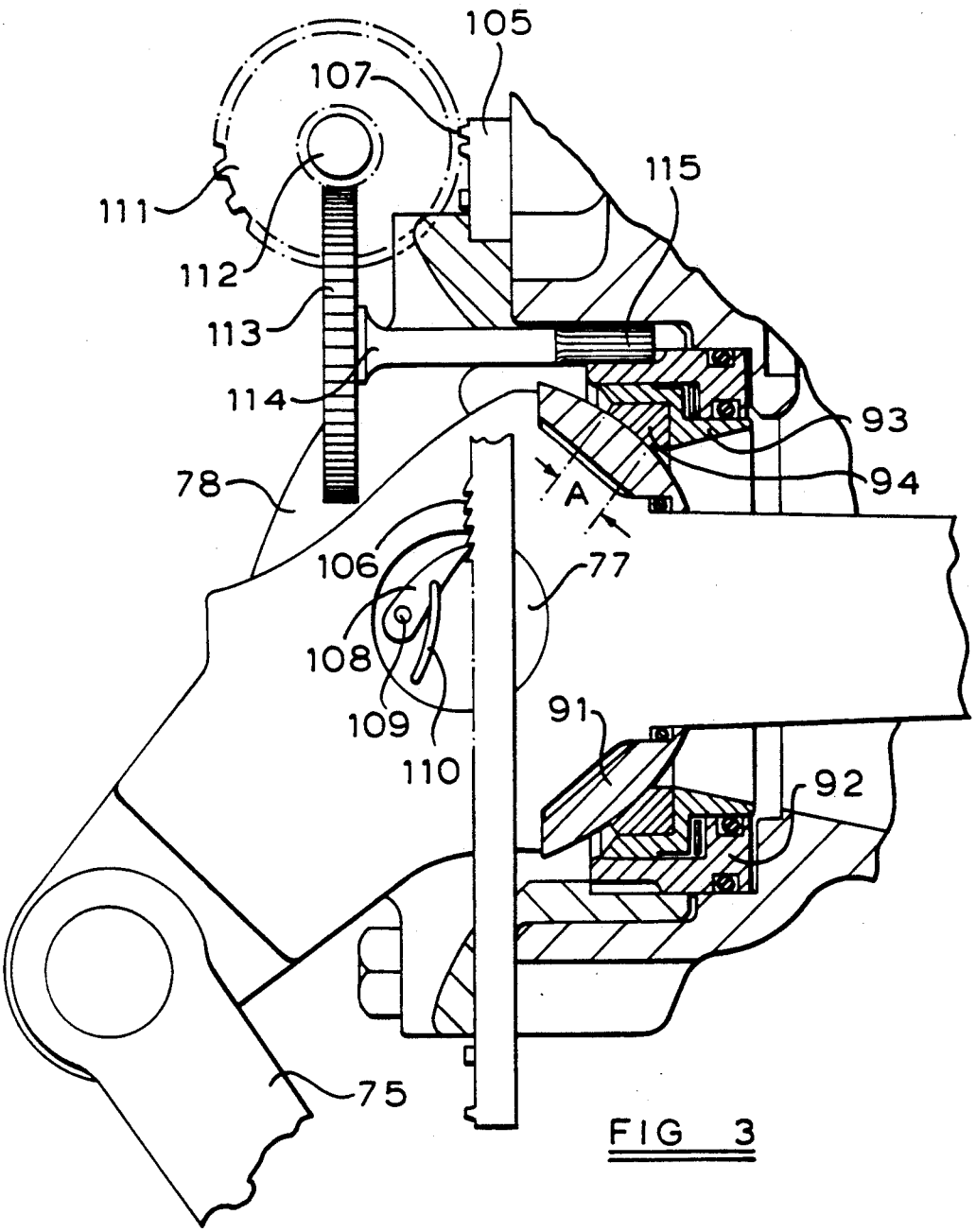
FIG. 3 shows a modification of part of FIG. 2

A gas-tight seal is associated with pivotal movement of the lever arm 74. The lever arm itself carries a part-spherical seal seat 91 which is mounted on the lever arm with its centre coincident with the centre of the pivot axis of the lever arm. A fixed annular seal carrier 92 is mounted in casting 43 and carries a movable seal holder 93 which in turn carries an annular seal member 94 with a part-spherical surface in contact with the corresponding surface of the seal seat 91. An annular spring 95 which may be in the form of a wavy washer is arranged to urge the seal holder 93 and the seal member 94 in an outward direction to provide sealing contact with seat 91. A series of O-rings 96, 97 and 98 provide further sealing between components of the seal assembly. The seal member itself may be of a highly impenetrable grade of PTFE/bronze composite, possible alternatives being polyimide resins or PTFE/polyimide mixtures. The seal seat may have a ground stainless steel surface or it may be electroless plated with PTFE and a metal. A ceramic seal seat is an alternative. The seal is self adjusting in that as wear takes place at the spherical bearing surfaces, the seal member and seal holder are maintained in contact with the seal seat. The seal is arranged to be such that internal pressure within the cylinder acts on the seal holder both to increase the bearing pressure between the seal member and the seal seat and to move the seal holder in a direction to take up wear. Effective take up of wear is possible because the movement available has a component normal to the wearing surfaces Spring 95 establishes initial contact for sealing purposes FIG. 3 is a scrap view of part of an engine corresponding to that of FIG. 2 but showing a modification whereby the seal member 94 is caused to rotate slowly in order to even out wear in the seal member. It should be explained that the peripheral speed of the seat 91 is much greater in relation to the seal member 94 at regions near to the plane of movement of the lever arm 74 than it is at positions 90° around the periphery of the seal member.

The mechanism which provides this rotation is as follows. A drive ring 105 is mounted in an annular recess machined in the periphery of the pivot housing 78. The drive ring 105 incorporates a ring of ratchet teeth 106 and a single start scroll gear 107 on its outer face. A pawl 108 mounted on pivot 109 on pivot pin 77 is held in engagement with the ratchet teeth by spring 110.

Reciprocatory movement of lever arm 74 thus indexes the drive ring 105 through the distance of one ratchet tooth for each revolution of the engine. Scroll gear 107 in turn drives gear 111 and worm gear 112 mounted for rotation therewith. Worm gear 112 drives a further gear 113 which has a shaft 114 extending into the pivot housing 78 and also has pinion gear 115 which engages with corresponding external gear teeth around the periphery of the outer seal carrier 92. A recess in the lever arm provides clearance for gear 113 With this modification, the seal holder 93 is engaged with seal carrier 92 in such a manner that both are caused to rotate together. This engagement may for example be provided by a pin in a keyway.

In use of the engine, movement of the lever arm indexes the drive ring 105 which in turn rotates the various gear elements 111, 112, 113 and 115 to thereby cause rotation of the seal member 94 derived from movement of the lever arm. The gearing should be such that one turn of seal member 94 occurs in several hours of running of the engine. By this means, wear of the seal member is evened out to provide it with a longer life and also to provide more effective sealing.

Another important feature of the seal arrangement as described in both FIGS. 2 and 3 is as follows. The objective of this feature is to ensure that no part of the seal seat 91 which is in use exposed to the working gas in the interior of the engine should at any time be exposed to the region on the other side of the seal, namely in the engine crankcase. This is achieved by suitable dimensioning of the width A of the seal as shown in FIG. 3 in relation to the limits of pivotal movement of the lever arm. In particular, the width of the sealing surface should be greater than the movement of the corresponding part of the seat 91 when the lever arm moves between its limits of pivotal movement. Considered another way, there is always a specific annular area on the surface of the seat which is and always remains in engagement with the sealing surface.

The engine shown in FIG. 2 is a double acting four-cylinder Stirling engine corresponding to the layout shown in FIG. 1. Only one cylinder is shown. In use, the region of the cylinder above the piston is a hot working chamber and the region of the cylinder below the piston is a cold working chamber. This lower region departs somewhat from cylindrical shape due to the mechanical connection to a piston via the lever arm 74 and due to the mounting of the piston guide. This shape departs further from that of a cylinder as such due to the requirement for reducing the effective volume below the piston to a reasonable minimum when the piston is at its lowermost position. However, pressure below the piston acts on the full area of the piston, providing in effect a full area piston extending across the cylinder and subject to pressure.

In use, the working space within the cylinder below the piston is operated as a cold working chamber in the Stirling engine with the result that working gas is at a relatively low temperature. This keeps the temperature of the lower bearing pad 56 low. On the other hand, the upper bearing pad 58 is remote from the main cold working space below the piston and could be at an undesirably high temperature due to heat transfer through the piston from the hot working chamber. To reduce this effect, cold working fluid is caused to flow past the upper bearing pad. The pad carrier 57 is provided with vents 99 to allow working gas to pass through it. The annular volume 100 immediately above the piston guide 52 and also confined by members 64 and 65 increases and decreases during engine reciprocation, causing cold working gas to pass through the vents 99. Some gas in volume 100 also enters and leaves through the annular gap between filler member 64 and the interior of piston guide 52 but by keeping this gap to a reasonable minimum there is significant gas flow through the vents. This flow of gas tends to hold down the temperature of the bearing pad carrier 57 and bearing pad 58.

The vents 99 may be made asymmetric s that air flows more easily in one direction through them than in the other direction. For example, one end may be provided with a sharp acute angled edge while the other end is provided with a rounded edge. The result of such an arrangement is a net circulation of cooling working fluid through the bearing pad carrier 57 instead merely of equal alternate flows in both directions.

The arrangement shown allows a compact four-cylinder engine to be produced. The cylinders are arranged in two parallel banks of two cylinders, one to each side of the crankshaft axis 72. The two banks are offset in the direction of the crankshaft by a distance equivalent to half the pitch between the cylinders in one bank. This allows clearance for pivot housing 78 and connecting rod 75 between lower minor diameter portions of two cylinders of the other bank, thus allowing the major diameter portions of the two cylinder banks to be close together and thereby permitting a compact design. Although a relatively long cylinder is required to accommodate the piston body tube and piston guide, the lower part of this cylinder is of reduced diameter which conveniently provides clearance for the crankshaft. Thus a compact overall engine design can be provided.

In the usual way for a Stirling engine the hot working chamber of one cylinder is in continuous connection through heating and cooling facilities with the cold working chamber of another cylinder which is operating at an appropriate phase angle to the first mentioned cylinder.

As a departure from the four cylinder double-acting layout, two single acting cylinders could be employed.

A further alternative would be a single cylinder arrangement with a supplementary lower piston co-axial with the main piston. The supplementary piston should be connected to the crankshaft at such a phase angle as to provide the required relationship between expansion and contraction of the hot and cold working chambers so that the chambers from the same cylinder can be interconnected to provide a Stirling engine.

I claim:

1. A Stirling Engine comprising a housing, a drive member, a cylinder defined within the housing whereby the housing defines a cylinder wall, an aperture defined in the cylinder wall, a piston mounted for reciprocation in the cylinder, a pivot bearing having a pivot axis fixed with respect to the housing, a connection between the piston and the drive member comprising a lever arm having two ends and being pivotally mounted about the pivot bearing intermediate the ends of the lever arm and extending through the aperture, and a gas seal arranged to prevent escape of pressure from the cylinder through the aperture around the lever arm, the seal comprising a part spherical seat on the lever arm with its centre coincident with the pivot axis, an annular seal member sealingly mounted with respect to the housing and having a part spherical sealing surface in sealing contact with the part spherical seat and means for urging the seal member into sealing engagement with the seat.

2. A Stirling Engine as claimed in claim 1 wherein the pivot bearing comprises a pivot housing fixed with respect to said housing and a pivot pin passing through the lever arm and mounted at both ends thereof in said pivot housing.

3. A Stirling Engine as claimed in claim 1 comprising limits of pivotal movement for the lever arm defined by the connection between the piston and the drive member, the sealing surface having a width which is greater than a distance defined by movement of a corresponding part of the spherical seat when the lever arm moves between its limits of pivotal movement such that there is a specific annular area on the surface of the seat which is and always remains in engagement with the sealing surface.

4. A Stirling Engine as claimed in claim 1 further comprising a movable seal holder within which the seal member is carried.

5. A Stirling Engine as claimed in claim 3 further comprising a fixed seal carrier within which the movable seal holder is supported and wherein the seal carrier is urged by gas pressure in the engine into engagement with the seal seat.

6. A Stirling Engine as claimed in claim 5 further comprising a spring arranged to urge the seal carrier into engagement with the seal.

7. A Stirling Engine as claimed in claim 1 wherein the engine is a double-acting Stirling Engine having a hot working chamber and a cold working chamber and wherein the lever arm extends through the cylinder wall into the cold working chamber thereof.

8. A Stirling Engine as claimed in claim 1 further comprising means to rotate the annular seal member bout its own axis to distribute wear evenly around the sealing surface.

9. A Stirling Engine as claimed in claim 8 comprising drive means for seal member rotation operatively connected to the lever arm and to the seal member to rotate the seal member in response to movement of the lever arm.

10. A Stirling Engine as claimed in claim 9 further comprising a pawl, a ratchet wheel and a reduction gear, wherein the pawl is operated by movement of the lever arm and engages the ratchet wheel which in turn drives the seal member through the reduction gear.

* * * * *